United States Patent [19]

Via

[11] 3,952,847

[45] Apr. 27, 1976

[54] WEATHERPROOF ARTICLE ENCLOSURE

[76] Inventor: Hazel H. Via, Box 7429-V Wyndotte St., Rte. No. 1, Sarasota, Fla. 33577

[22] Filed: May 28, 1975

[21] Appl. No.: 573,139

[52] U.S. Cl. ..... 190/41 Z; 150/1; 190/53; 206/281; 206/287

[51] Int. Cl.[2] ..... B65D 85/18

[58] Field of Search ..... 312/3, 4; 206/278, 281, 206/286, 287, 315, 457; 190/26, 41 Z, 43, 53, 54

[56] References Cited

UNITED STATES PATENTS

| | | | |
|---|---|---|---|
| 2,293,625 | 8/1942 | Patch | 206/287 X |
| 2,428,682 | 10/1947 | Rhodes | 150/28 A |
| 2,429,962 | 10/1947 | Reilly | 190/53 |
| 2,808,194 | 10/1957 | Dols | 206/457 X |
| 2,935,182 | 5/1960 | Cater | 206/287 X |
| 3,244,261 | 4/1966 | Herz | 190/43 |
| 3,746,151 | 7/1973 | Brophy | 206/287 |
| 3,834,497 | 9/1974 | Furst | 190/43 |

*Primary Examiner*—Donald F. Norton
*Attorney, Agent, or Firm*—Clarence A. O'Brien; Harvey B. Jacobson

[57] ABSTRACT

A weatherproof article enclosure for sporting equipment and accessories is in the form of a bag constructed from a flexible, decorated, planar material, such as a suitable print fabric, arranged forming an article receiving cavity and provided with an opening communicating with the cavity to permit access to the cavity. Arranged over, and contacting, the planar material is a transparent sheet material, such as a vinyl, that protects the planar material and weatherproofs the bag.

3 Claims, 2 Drawing Figures

WEATHERPROOF ARTICLE ENCLOSURE

BACKGROUND OF THE INVENTION

1. Field of the Invention

The present invention relates generally to a weatherproof article enclosure, and particularly to a weatherproof, decorated cover for sporting equipment and accessories, such as sportswear and the like.

2. Description of the Prior Art

The current great interest in participation sports and attendance at sporting events has created an increasing demand for covers and enclosures to protect sporting equipment and accessories, including sportswear, while same is being transported to and from the site of a sporting event.

Prior patents believed pertinent to the present invention are as follows:

| | |
|---|---|
| 1,048,818 | Dec. 31, 1912 |
| 1,629,362 | May 17, 1927 |
| 2,481,102 | Sept. 6, 1949 |
| 2,487,596 | Nov. 8, 1949 |
| 2,584,722 | Feb. 2, 1952 |

SUMMARY OF THE INVENTION

It is an object of the present invention to provide a decorative cover or enclosure for sporting equipment and accessories that is rugged of construction, but compact and easily stored.

It is another object of the present invention to provide a construction for weatherproof covers and enclosures that is of simple yet rugged construction, and lends itself to the use of decorative designs and patterns appropriate to the intended use of the cover or enclosure.

These and other objects are achieved according to the present invention by providing a weatherproof article enclosure, especially for sporting equipment and accessories, having: a bag constructed from a flexible, planar material arranged forming an article receiving cavity and provided with an opening communicating with the cavity for facilitating access to the cavity; and a transparent sheet material arranged over, contacting, and connected to the planar material for protecting the planar material and weatherproofing the bag.

The planar material advantageously includes an opaque, print fabric arranged with a pattern, or design, of the fabric facing the sheet material for viewing through the latter. As used herein, the term "print fabric" is intended to describe any fabric having therein or thereon markings forming a pattern. By the word "pattern" is meant any pattern, design, and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
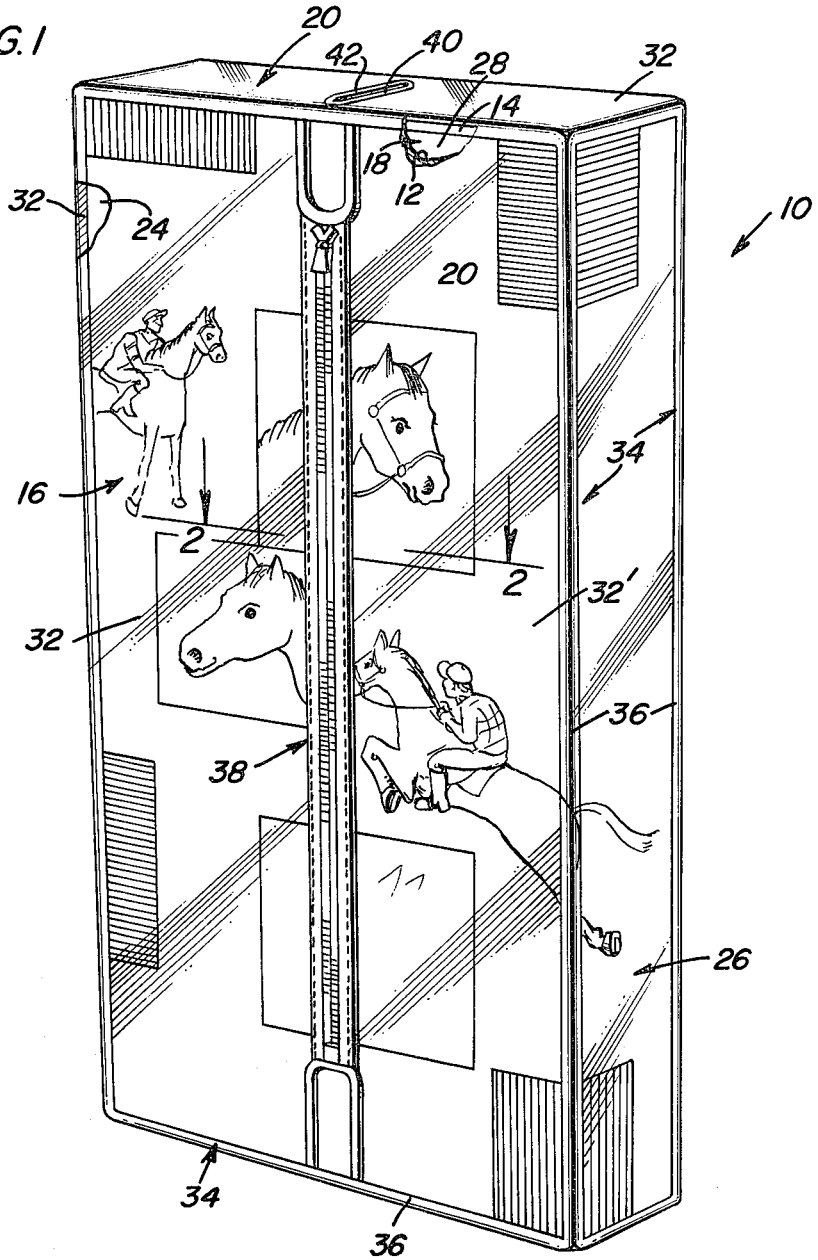
FIG. 1 is a perspective view, partly cutaway and in section, showing a garment bag constructed in accordance with the present invention.
Figure 2:
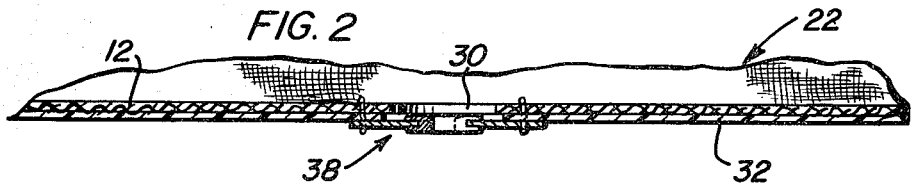
FIG. 2 is a fragmentary, sectional view taken generally along the line 2—2 of FIG. 1.

Referring now more particularly to the drawings, a weatherproof article enclosure for sporting equipment and accessories is illustrated in the form of a garment bag 10 constructed from a flexible, planar material 12 and 14 formed by a substantially rectangular front panel 16, a substantially rectangular back panel 18 arranged substantially parallel to front panel 16, and top and bottom panels 20 and 22, respectively, and similar, rectangular, side panels 24 and 26. While all of the aforementioned panels are illustrated as being substantially rectangular, it is to be understood that the panels may take other suitable configurations as desired. The top and bottom panels 20 and 22 and the side panels 24 and 26 are arranged between and are connected to peripheral portions of front and back panels 16 and 18 in a suitable manner, as to be described in greater detail below. Thus arranged, the various panels form a bag 10 having an article receiving cavity 28 and provided with an opening 30 communicating with cavity 28. As can be seen from the drawing, opening 30 bisects front panel 16 between top panel 20 and bottom panel 22.

A transparent sheet material 32, such as polyvinyl chloride and the like, is arranged over, contacting, and connected to planar material 12, 14 for protecting planar material 12, 14 and weatherproofing bag 10. Advantageously, planar material 12 is an opaque print fabric of conventional construction arranged with a pattern provided on the fabric facing sheet material 32 arranged over material 12 for viewing the pattern through the overlying sheet material 32. In this manner, by using fabric, and the like, provided with appropriate patterns and designs depicting sporting events, and the like, a weatherproof, yet decorative, cover or enclosure can be constructed in a simple manner.

Portions of planar material 12, 14, specifically the panels 16, 18, 20, 22, 24, and 26, are attached along the peripheral portions thereof as at seams 34 to form bag 10. Further, sheet material 32 is connected to the fabric or other planar material 12, 14 at the seams 34 thereof, while a, for example, leather welting covers seams 34 for facilitating attachment of the portions, or panels, of material 12, 14 to one another and to material 32. As will be appreciated, welting 36 may be attached to material 12, 14, and 32 in a conventional manner, as by stitching.

A fastener 38, which may be a conventional heavy duty zipper bound with leather welting, is fastened to panel 16 of bag 10 and is arranged for cooperating with opening 30 provided in bag 10 for permitting opening 30 to be selectively opened and closed in a known manner.

Bag 10 further includes an aperture 40 provided in top panel 20 and arranged for receiving a hook (not shown) of a conventional coat hanger (not shown), and the like, for permitting clothes covered by bag 10 to be hung on a suitable bracket or rod in a manner well known. Leather reinforcement 42 is advantageously provided around the edges of aperture 40 for reinforcing the aperture 40, while material 14 partially forming top panel 20 is advantageously a natural or synthetic suede so as to further enhance the aesthetic appeal of a garment bag or similar enclosure or cover constructed in accordance with the present invention.

As will be appreciated from the above description and from the drawing, a cover or enclosure constructed in accordance with the present invention provides a simple yet rugged article which is compact and easily stored. Further, in addition to a garment bag as shown in the drawing, other sports equipment and accessories may be covered or enclosed by employing the same novel construction. That is, a suitable sports print cloth with a clear vinyl, and the like overlying the cloth, and the cloth and vinyl bound in, for example, contrasting welting.

Among other covers and enclosures which can be constructed for various articles of sporting equipment and accessories, are: tennis racket covers; saddle covers; boot bags; golf bags; bowling ball bags; various bags used in conjunction with sport aviation, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A weatherproof article enclosure for sporting equipment and accessories, comprising, in combination:

a. a bag constructed from a flexible, planar material arranged forming an article receiving cavity and provided with an opening communicating with the cavity for facilitating access to the cavity;

b. a transparent sheet material arranged over, contacting, and connected to the planar material for protecting the planar material and weatherproofing the bag, said planar material including an opaque, print fabric arranged with a pattern of the fabric facing the sheet material for viewing the pattern through the sheet material, protions of said planar material being attached along seams to form the bag with the sheet material being connected to the planar material at the seams, and leather welting covering the seams for facilitating attachment of the planar material portions to one another and to the sheet material, and assuring weatherproofing of the bag.

2. A structure as defined in claim 1, wherein a fastener is mounted on the bag and arranged for cooperating with the opening provided in the bag for permitting the opening to be selectively opened and closed.

3. A structure as defined in claim 2, wherein the bag is in the form of a garment bag having a substantially rectangular front panel, a substantially rectangular back panel arranged substantially parallel to the front panel, and top, bottom, and side panels arranged between and connected to peripheral portions of the front and back panels, the opening bisecting the front panel between the top and bottom panels, the fastener being a zipper bound with leather welting, and further including an aperture provided in the top panel and arranged for receiving a hook of a coat hanger, leather reinforcing the aperture, with the top panel being constructed from a suede material.

* * * * *